US005779148A

United States Patent [19]

Saarem et al.

[11] Patent Number: 5,779,148

[45] Date of Patent: Jul. 14, 1998

[54] POP-UP SPRINKLER WITH PRESSURE REGULATOR

[75] Inventors: Myrl Saarem, Carson City, Nev.; Alan W. Dawn, Murrieta, Calif.

[73] Assignee: The Toro Company, Riverside, Calif.

[21] Appl. No.: 701,152

[22] Filed: Aug. 21, 1996

[51] Int. Cl.[6] ..... B05B 1/28; B05B 15/10

[52] U.S. Cl. ..... 239/104; 239/205; 239/571

[58] Field of Search ..... 239/200, 201, 239/203–205, 76, 101, 104, 569–571; 277/205; 137/505, 504, 497, 494

[56] References Cited

U.S. PATENT DOCUMENTS

| | | | |
|---|---|---|---|
| 876,977 | 1/1908 | Larsson | 277/205 |
| 2,081,040 | 5/1937 | King | 277/205 X |
| 3,712,333 | 1/1973 | Semon | 137/498 |
| 3,837,363 | 9/1974 | Meronek | 138/45 |
| 3,842,859 | 10/1974 | Reinke | 137/504 |
| 3,921,991 | 11/1975 | Beck | 277/205 |
| 3,948,285 | 4/1976 | Flynn | 137/494 |
| 4,080,993 | 3/1978 | Lind, Jr. | 137/504 |
| 4,234,125 | 11/1980 | Lieding | 239/111 |
| 4,474,207 | 10/1984 | Rosenberg | 137/505 |
| 4,479,611 | 10/1984 | Galvis | 239/205 |
| 4,669,495 | 6/1987 | Boyce | 137/117 |
| 4,681,260 | 7/1987 | Cochran | 239/570 X |
| 4,913,352 | 4/1990 | Witty et al. | 239/104 |
| 5,215,254 | 6/1993 | Haruch | 239/107 |
| 5,265,803 | 11/1993 | Thayer | 239/71 |

*Primary Examiner*—Lesley D. Morris
*Attorney, Agent, or Firm*—Richard L. Myers

[57] ABSTRACT

A pop-up sprinkler which includes a housing, a riser in the housing movable between an extended position in which the riser extends from the housing and a retracted position in which the riser is retracted from the extended position and a pressure regulator in the riser. The pressure regulator can be constructed as a cartridge or separate unit and installed in the riser. The riser has an aperture adjacent the pressure regulator and the aperture is between first and second axially spaced seals in the extended position so as to reduce the likelihood of clogging of the aperture. A dirt tolerant wiper seal is mounted on a movable valve tube of the pressure regulator and a pressure activated seal is provided between a valve seat of the pressure regulator and the valve tube.

26 Claims, 3 Drawing Sheets

Fig. 3
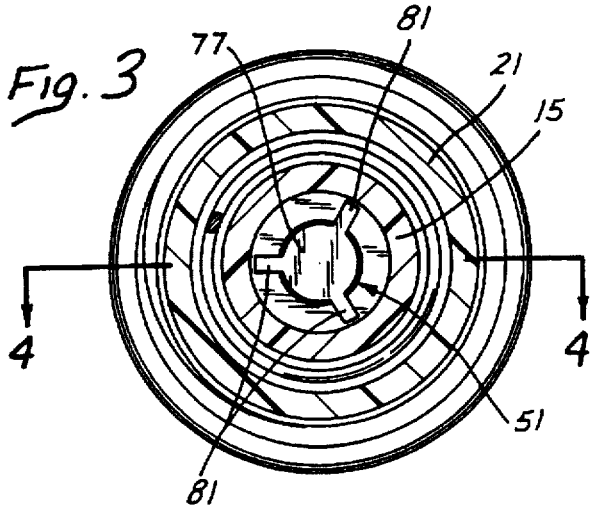
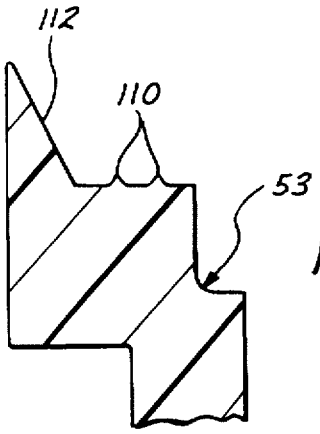
Fig. 4A
Fig. 5
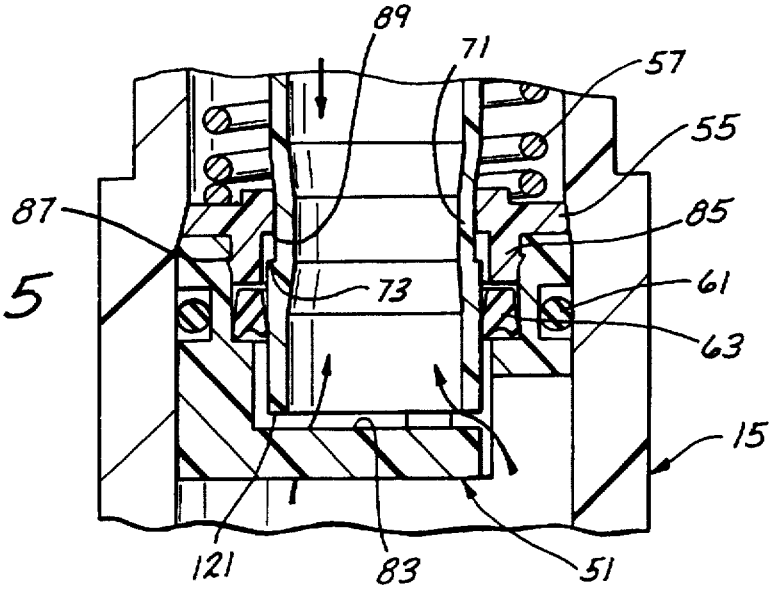

POP-UP SPRINKLER WITH PRESSURE REGULATOR

BACKGROUND OF THE INVENTION

A pop-up sprinkler for use in irrigation typically includes a housing, a riser in the housing movable between an extended position in which the riser extends from the housing and a retracted position in which the riser is retracted from the extended position, and a spring for urging the riser toward the retracted position. When the irrigation water is turned on, the water pressure forces the riser to the extended position against the biasing action of the spring and the water is sprayed from the riser.

An irrigation system may include many pop-up sprinklers, and not uncommonly many of these receive water at different pressures. This may be caused, for example, by certain sprinklers being nearer the source of water than others and/or by differences in elevation among the sprinklers. To address this problem, it is known to provide a pressure regulator within the riser of the pop-up sprinkler, and this tends to make the flow from each of the sprinklers more even.

Conventional pressure regulators for pop-up sprinklers of which the inventors are aware are assembled within the riser of the pop-up sprinkler. This tends to make assembly of the sprinkler more difficult and may make removal of the pressure regulator from the riser more difficult.

A pressure regulator that is operated by differential fluid pressures may require an aperture in the riser to act as a vent for the pressure regulator. It is known to provide first and second axially spaced seals carried by the housing and cooperable with the riser to seal around the riser. With this conventional construction, the first or inner seal is fluid tight and the second seal is a dust seal which also allows the passage of air. In the retracted position, the aperture is protected from particulates by these two seals. However, in the extended position the aperture is above both of these seals and is therefore exposed outside of the housing where it may become clogged, in which event the pressure regulator cannot function as intended.

A typical pressure regulator for a pop-up sprinkler may include a valve seat mounted within the riser and a valve tube movable within the riser and cooperable with the valve seat to provide pressure regulation. It is important to seal the interface between the movable valve tube and the inner wall of the riser, and it is known to attempt to accomplish this function with an O-ring. Unfortunately, an O-ring is not as tolerant as desired to debris and also may impose significant friction which inhibits movement of the valve tube.

It is also known to provide an O-ring between the movable valve tube and the valve seat. However, this O-ring also imposes significant frictional forces to the movement of the valve tube. It has been found that the relatively high friction imposed by these O-rings to movement of the valve tube increases hysteresis such that different results are obtained from the pressure regulator depending upon whether the pressure of the water is increasing or decreasing.

SUMMARY OF THE INVENTION

The features of this invention solve the problems noted above. For example, the pressure regulator of this invention is assembled outside of the riser and is subsequently mounted in the riser. This facilitates assembly as well as facilitating removal of the pressure regulator from the riser if that should become necessary or desirable. With this feature of the invention, pressure regulators can be maintained in stock and simply mounted into a riser. On the other hand, identical risers can be used without the pressure regulator for those applications where pressure regulation is not required or desired.

This invention also reduces the likelihood of clogging of the aperture in the riser. With this invention the aperture is located on the riser so as to be between the first and second seals in the extended position. Consequently, these seals reduce the likelihood of clogging of the aperture. The second seal allows the passage of air so that the aperture can serve as a vent for the pressure regulator; however, the second seal also serves to substantially exclude debris from the aperture.

To reduce friction at the valve tube-riser interface, this invention employs a wiper seal mounted on the valve tube and having an annular lip engageable with the riser above the upper end of the valve tube. A wiper seal with an annular lip is more effective than an O-ring in exclusion of debris. Moreover, the annular lip may only be lightly loaded by the resilience of the seal against the riser. The annular lip may be loaded by fluid pressure against the riser and so the frictional force of the lip against the riser is a function of the fluid pressure at that location. This can be contrasted with an O-ring which always applies a significant force to the riser.

To further reduce the frictional forces on the movable valve tube, this invention utilizes a pressure activated seal between the valve seat and the valve tube. This pressure activated seal may have a concave surface facing an inlet of the riser such that the concave face is responsive to inlet fluid pressure to apply a sealing force to the valve tube-valve seat interface with such force being a function of the fluid inlet pressure. In the absence of fluid pressure, this pressure activated seal preferably would not apply a sealing force to the valve tube and so no fluid-tight seal is obtained until inlet pressure acts on it. Preferably this seal is adjacent the lower end of the valve tube.

A preferred way to obtain the pressure regulator in cartridge form is to couple the valve tube to the valve seat so as to form a cartridge or structure which can be installed as a unit or an assembly in the riser. Preferably, all components of the pressure regulator are attached to the valve tube. For example, the spring may be positioned between a shoulder on the valve tube and the valve seat. The valve seat is coupled to the valve tube so as to prevent separation of the valve seat and valve stem by the spring.

In a preferred construction, cooperating shoulders are provided for preventing separation of the valve tube and the valve seat. This may be accomplished, for example, by employing a spring support which is coupled to the valve seat and providing the cooperating shoulders on the spring support and the valve tube.

In a preferred construction, a seal cap mounts the wiper seal on the valve tube. The wiper seal advantageously may include an annular base and a peripheral section which can advantageously be or include a frustoconical section. The frustoconical section includes the annular lip. The seal cap may be attached to the valve tube and retain the base between the valve tube and the seal cap. Preferably, but not necessarily, the base is loosely received between the seal cap and the valve tube so that the base can float. This assures that the base will not be subjected to mechanical clamping forces which might distort the frustoconical section and adversely affect the seal obtained by the annular lip. The seal cap may be spaced from at least a portion of the frustoconical section to allow fluid pressure loading of the annular lip against the riser. The seal cap and valve tube cooperate to support the frustoconical section against rolling up during use.

The features of this invention are applicable to sprinklers in which pressure regulation is desired. For example, the features of this invention are applicable to rotary pop-up sprinklers as well as to the non-rotary sprayhead type of pop-up sprinklers.

The invention, together with additional features and advantages thereof may best be understood by reference to the following description taken in connection with the accompanying illustrative drawings.

BRIEF DESCRIPTION OF THE DRAWINGS

FIG. 3 is a sectional view taken generally along line 3—3 of FIG. 1.

FIG. 4A is an enlarged sectional view of a portion of FIG. 4 illustrated generally by the arrows 4A.

FIG. 5 is a fragmentary sectional view similar to a portion of FIG. 4 illustrating the pressure regulator in a position to restrict flow through the sprinkler.

DESCRIPTION OF THE PREFERRED EMBODIMENT

Figure 1:
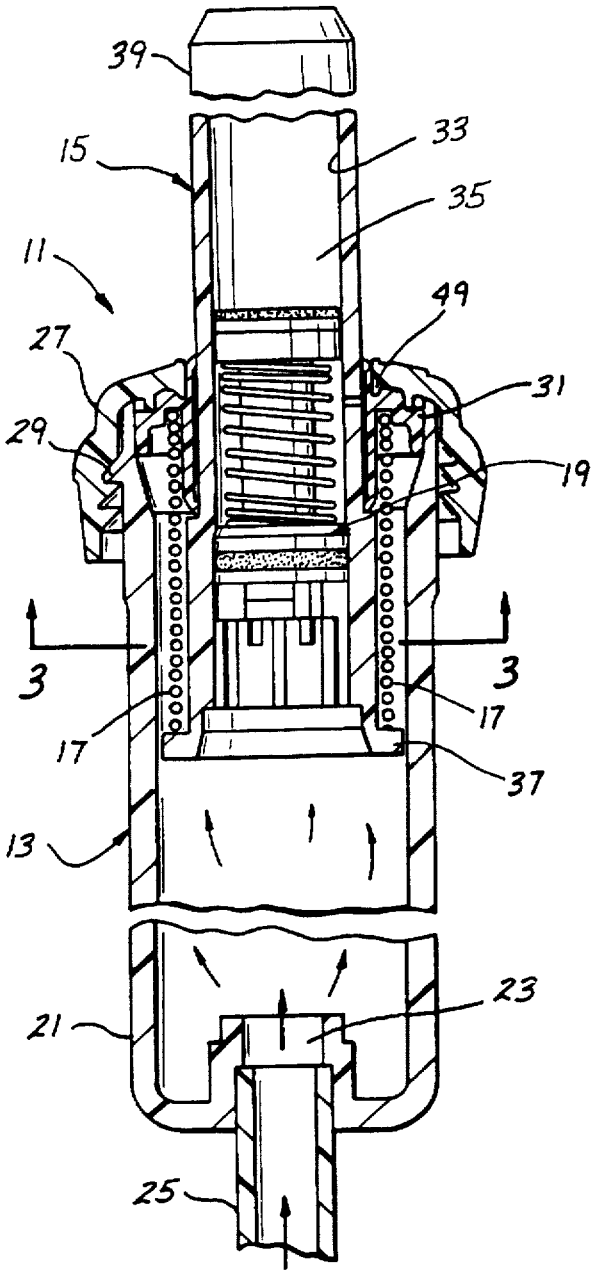
FIG. 1 is a fragmentary, axial sectional view of a pop-up sprinkler constructed in accordance with the teachings of this invention coupled to an inlet conduit and with the riser in the extended position.

FIG. 1 shows a pop-up sprinkler 11 which generally includes a housing 13, a riser 15, a spring 17 and a pressure regulator 19. The housing 13 includes a case 21 molded from a suitable polymeric material and having an inlet 23 coupled to a supply conduit 25 of an irrigation system (not shown). The housing 13 also includes a cap 27 attached by threads 29 to the upper end of the case 21 and closing the upper end of the case. A seal member 31 is mounted on the housing 13 just inside the cap 27 and is discussed more fully below.

The riser 15 in this embodiment is a polymeric tube having an inner wall 33 defining an axially extending, cylindrical passage 35 which extends completely through the riser. An integral flange 37 is provided at the lower end of the riser 15 and the upper end of the riser receives a sprinkler head 39.

The riser 15 is movable in response to pressure of the fluid from the inlet 23 in a conventional manner from a retracted position in which the riser is closely adjacent the inlet 23 and the sprinkler head 39 is substantially flush with the upper end of the cap 27 to an extended position shown in FIG. 1 in which the riser extends from the housing 13 so that the sprinkler head 39 can direct water from the sprinkler. In this position, water flows from the inlet 23 through the pressure regulator 19 in a manner that will be more apparent from the discussion below with respect to FIGS. 4 and 5 through the passage 35 to the sprinkler head 39. The spring 17 acts between the seal member 31 and the flange 37 to resiliently bias the riser 15 toward the retracted position.

The seal member 31, which may be of a suitable elastomeric material such as Santoprene, includes an annular, resilient, pressure activated seal 41 (FIG. 4) which seals against the upper end of the case 21. The seal member 31 also includes a pressure activated, fluid-tight, integral inner seal 43 and an integral outer seal 45 which is not air tight and which serves a dust seal. The seals 43 and 45 are annular and axially spaced. The seals 43 and 45 seal against an outer surface 47 of the riser 15.

The riser 15 has an aperture 49 (FIG. 4) which serves as a vent for the pressure regulator 19. In the extended position shown in FIG. 4, the vent 49 is between the seals 43 and 45. Consequently, the seals 43 and 45 reduce the likelihood of clogging of the aperture 49. The seal 45 is not air tight and allows the passage of air between the vent 49 and the environment outside of the sprinkler and consequently, the seal 45 enables the aperture 49 to serve as a vent for the pressure regulator 19 which excludes debris and particulate contaminants from the aperture.

The pressure regulator 19 includes a valve seat 51 (FIGS. 2 and 4), a valve tube 53 coupled to the valve seat, an annular spring support 55 coupled to the valve seat, a spring 57 acting between the spring support 55 and a shoulder 59 of the valve tube 53, an O-ring seal 61 acting between the valve seat and the riser 15, a pressure activated seal 63 adjacent the lower end of the valve tube between the valve seat and the valve tube, a wiper seal 65 mounted on the valve tube and a seal cap 67 mounted on the valve tube 53 for mounting the wiper seal on the valve tube. The valve tube 53, which is preferably constructed of a suitable polymeric material such as acetal, has an axial cylindrical passage 69 extending completely through it and a wall region 71 of reduced outside and inside diameters. The wall region 71 terminates downwardly or inwardly in a shoulder 73.

Figure 2:
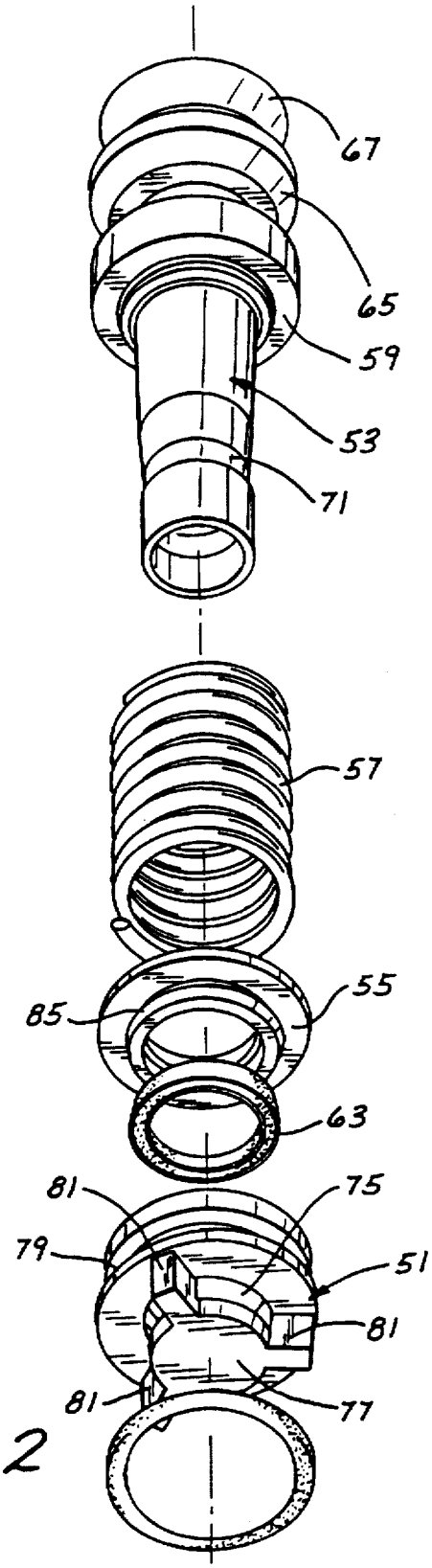
FIG. 2 is an exploded perspective view of the pressure regulator.

The valve seat 51, which may also be constructed of a suitable polymeric material such as acetal, is generally annular as best seen in FIG. 2 and has a central opening 75 facing an end wall 77. The valve seat 51 also has a main body 79 and the end wall 77 is attached to the main body 79 in axially spaced relationship to the main body by three webs 81. The end wall 77 has an upper surface which forms a valve seat surface 83 (FIGS. 4 and 5) which faces the lower end of the valve tube 53.

Figure 4:
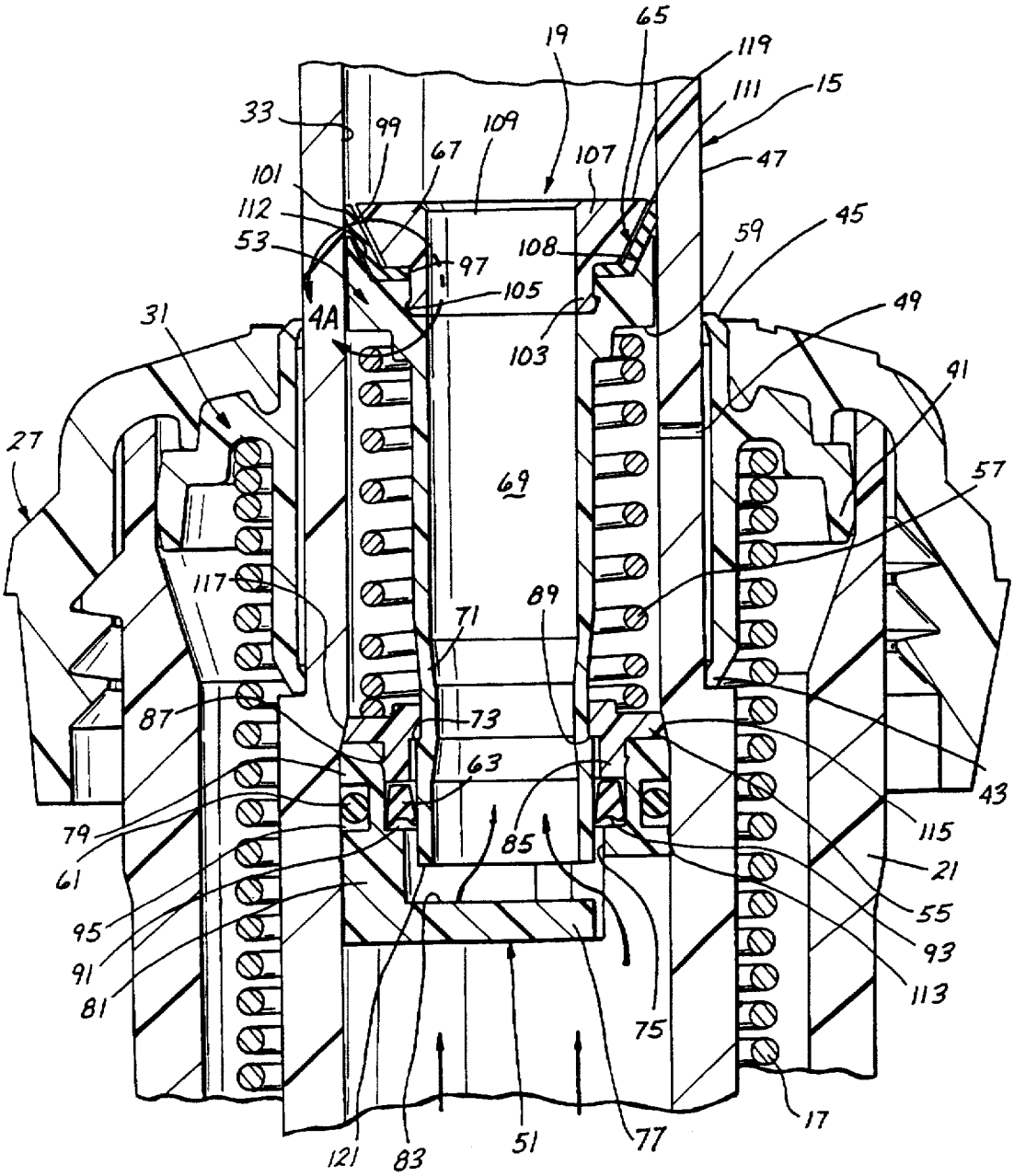
FIG. 4 is an enlarged, fragmentary sectional view taken generally along line 4—4 of FIG. 3 with the riser in the extended position.

The spring support 55 is annular and has a boss 85 which is received within an upper region of the main body 79 of the valve seat 51. The spring support 55 is coupled to the valve seat 51 in any suitable manner such as by an interference fit provided by an annular barb 87 on the spring support 55. As shown in FIG. 4, the spring 57 engages the shoulder 59 at one end and the spring support 55 at the other and urges the valve seat 51 downwardly away from the valve tube 53. However, the spring support 55 has a shoulder 89 which engages the shoulder 73 on the valve tube 53 to prevent separation of the valve seat and valve tube by the spring.

The spring support 55 and the valve seat 51 cooperate to define an annular groove 91 which receives the pressure activated seal 63. The pressure activated seal 63, which may be constructed of a suitable elastomer such as Santoprene, is not squeezed sufficiently between the valve seat 51 and the valve tube 53 to obtain a fluid-tight seal. However, the seal 63 is pressure activated by the fluid under pressure from the inlet 23 (FIG. 1) and when pressure activated deforms sufficiently in a radial direction to sealingly engage both the valve seat 51 and the valve tube 53. To assist in making the seal 63 pressure activated, it may be a cup seal having a concave surface 93 facing the fluid under pressure from the inlet 23 and facing downwardly as shown in FIG. 4.

The valve seat 51 has an outwardly facing annular groove 95 for receiving the O-ring seal 61. Because the seal 61 is a static seal, i.e. does not experience relative movement along the sealing surface, it need not be pressure activated.

The wiper seal 65 which is preferably constructed of a suitable elastomer such as Santoprene is generally basin or pan shaped. The wiper seal 65 includes an annular base 97 and a peripheral section which in this embodiment is a frustoconical section 99. The frustoconical section 99 terminates outwardly in an annular lip 101 which is slidably engageable with the inner wall 33 of the riser 15 above the valve tube 53.

Although the wiper seal 65 can be mounted on the valve tube 53 in different ways, it is preferred to utilize the seal cap 67 which preferably is a rigid annular member constructed of a suitable polymeric material such as acetal, Celcon M90. The seal cap 67 has an annulus 103 which is received in the upper end of the valve tube 53 and suitably attached to the valve tube. In this embodiment, an annular barb 105 on the annulus 103 forms an interference-fit with the upper end of the valve tube 53.

The seal cap 67 has an annular flange 107 and a passage 109 extending axially through the seal cap which forms an extension of the passage 69 of the valve tube 53. The base 97 of the wiper seal 65 floats between the flange 107 of the seal cap 67 and the valve tube 53 with, for example, about 0.005 inch clearance so the wiper seal 65 is retained without mechanically clamping the base 97 and without distorting the frustoconical section 99 and the annular lip 101. Preferably, the valve tube 53 has one or more annular ridges 110 (two being shown in FIG. 4A) for a purpose described below.

The periphery 108 of the flange 107 is frustoconical and sized and shaped somewhat complementary to the frustoconical section 99 of the wiper seal 65. The periphery of the flange 107 is spaced radially inwardly a small distance from the section 99 of the wiper seal 65 to form an annular gap 111. This annular gap allows the pressure of the water downstream of the pressure regulator 19 to enter the gap 111 and perform two important pressure loading functions. First, the pressure loads the frustoconical section 99 and in particular the lip 101 against the inner wall 33 of the riser 15. Secondly the pressure forces the elastomeric base 97 against the ridges 110 to provide a labyrinth seal, and this is less likely than mechanical clamping forces to distort the frustoconical section 99 and the lip 101 Thus, the sealing forces of the lip 101 against the inner wall 33 and the base against the ridges 110 are a function of the water pressure downstream of the pressure regulator 19. The wiper seal 65 and in particular the annular lip 101 can slide along the inner wall 33 of the riser 15 with minimal friction and is quite effective in excluding debris and particulates which, if they were allowed to get between the inner wall of the riser 15 and the valve tube 53, could impede movement of the valve tube and render the pressure regulator 19 wholly or partially inoperative.

The valve tube 53 has a frustoconical wall 112 for supporting the outside of the frustoconical section 99. The periphery 108 and the wall 112 cooperate to support the frustoconical section 99 against rolling up in use.

The pressure regulator 19 can be assembled as a separate cartridge or unit outside of the riser 15 and stored until needed. When it is desired to produce a pop-up sprinkler having the pressure regulator 19, the pressure regulator is then mounted in the riser 15. The riser is then assembled into the housing 13 in a conventional manner.

The pressure regulator 19 can be easily installed within the riser 15 by sliding it up through the open bottom of the riser to the position shown in FIG. 4. A circumferentially extending barb 113 on the outside of the valve seat 51 has an interference fit with the inner wall 33 of the riser 15 to thereby retain the pressure regulator 19 in the riser against mechanical forces normally encountered by the sprinkler 11. The riser 15 also has a conical shoulder 115 and a correspondingly shaped conical outer surface 117 of the spring support 55 engages the shoulder 115 when the pressure regulator 19 is properly installed in the riser. Consequently, upward movement (as viewed in FIG. 4) of the pressure regulator 19 relative to the riser 15 is prevented by the surface 117 engaging the shoulder 115. During operation of the sprinkler 11 downward movement as viewed in FIG. 4 of the pressure regulator 19 with respect to the riser is prevented by differential pressure. Thus, the pressure regulator 19 can be easily installed in the riser 15 and can also be removed from the riser by pulling it downwardly as viewed in FIG. 4 with respect to the riser 15 with sufficient force to overcome the interference fit provided by the barb 113.

In use of the sprinkler 11 when water under pressure is supplied by the supply conduit 25 through the inlet 23, the water pressure moves the riser 15 against the biasing action of the spring 17 from the retracted position to the extended position of FIGS. 1 and 4 in a conventional manner. The seals 41 and 43 prevent water from leaking out between the case 21 and the cap 27 and between the housing 13 and the riser 15, respectively.

With water flowing through the passage 69 of the valve tube 53, a relatively large face 119 at the top of the valve tube is subjected to water at outlet pressure and a relatively small annular face 121 at the bottom of the valve tube 53 is subject to inlet pressure. The face 119 is of much larger area than the face 121, and accordingly, there is a net downward fluid force acting on the valve tube 53 which is resisted by the spring 57. If the outlet pressure of the water becomes sufficient to overcome the force of the spring 57, the valve tube 53 along with the wiper seal 65 and the seal 67 move downwardly to move the face 121 of the valve tube closer to the valve seat surface 83 as shown by way of example in FIG. 5. With the gap between the face 121 and the valve seat surface 83 reduced, there is a smaller cross-sectional area through which the water can flow. Consequently, there is an increased pressure drop across this gap and a reduction in fluid pressure downstream of the pressure regulator 19 acting on the face 119. In this manner, the pressure regulator can control the discharge pressure from the sprinkler 11.

It should be noted that the seal 61 prevents the entry of water into the annular space occupied by the spring 57. There is a path to ambient atmosphere from the shoulder 59 via the aperture 49 and the outer seal 45 so that the shoulder 59 is vented to atmosphere thereby allowing the differential fluid pressures acting on the valve tube 53 to operate the valve tube as described above. By locating the aperture 49 so that it is between the inner seal 43, which excludes water from the aperture 49, and the outer seal 45, which excludes particulates and debris from the aperture, there is assurance that the aperture will function as a vent.

When the valve tube 53 moves within the riser 15, the pressure activated seal 63 and the wiper seal 65, which is also pressure activated, frictionally resist such movement significantly less than conventional O-rings. This reduces the hysteresis in operation of the pressure regulator 19 during times of changing pressures and tends to make the pressure regulator more accurate.

Although an exemplary embodiment of the invention has been shown and described, many changes, modifications and substitutions may be made by one having ordinary skill in the art without necessarily departing from the spirit and scope of this invention.

We claim:

1. In a pop-up sprinkler which includes a housing, a riser in the housing movable between an extended position in which the riser extends from the housing and a retracted position in which the riser is retracted from the extended position, first and second axially spaced seals carried by said housing and cooperable with the riser, said second seal allowing the passage of air, a pressure regulator within said riser and an aperture in the riser adjacent the pressure regulator for providing a vent for the pressure regulator, the improvement comprising:

said aperture being located on said riser so as to be between the first and second seals in said extended position whereby the first and second seals reduce the likelihood of clogging of the aperture.

2. An improvement as defined in claim 1 further comprising:

a pressure regulator including a valve seat and a valve tube coupled to the valve seat; and a pressure activated seal disposed between the valve seat and the valve tube.

3. An improvement as defined in claim 1 further comprising:

a pressure regulator including a valve tube; and a pressure activated seal disposed between the valve tube and the riser.

4. An improvement as defined in claim 3 including a wiper seal mounted on the valve tube and having an annular lip engageable with the riser.

5. A pop-up sprinkler comprising:

a housing;

a riser in the housing moveable between an extended position in which the riser extends from the housing and retracted position in which the riser is retracted from the extended position;

a pressure regulator in said riser, said pressure regulator including a valve seat mounted within the riser and a valve tube moveable within the riser and cooperable with the valve seat to provide pressure regulation;

cooperating shoulders for preventing separation of the valve tube and valve seat; and said valve tube being coupled to the valve seat and forming a structure which can be installed as a unit in the riser.

6. A pop-up sprinkler as defined in claim 5 including a spring urging the valve tube and valve seat apart and the valve tube and valve seat are coupled to prevent separation of the valve seat and valve tube by the spring.

7. A pop-up sprinkler as defined in claim 6 including a spring support coupled to the valve seat and cooperating shoulders on the spring support and the valve tube to prevent separation of the valve seat and valve stem by the spring.

8. A pop-up sprinkler as defined in claim 7 including a pressure activated seal carried by the spring support and the valve seat and engageable with the valve tube.

9. A pop-up sprinkler as defined in claim 5 including a pressure activated seal between the valve seat and the valve tube.

10. A pop-up sprinkler as defined in claim 9 wherein the pressure activated seal is carried by the spring support and the valve seat, and is engageable with the valve tube.

11. A pop-up sprinkler as defined in claim 5 including a wiper seal mounted on the valve tube and having an annular lip engageable with the riser.

12. A pop-up sprinkler as defined in claim 5 further comprising a wiper seal including an annular base and a frustoconical section, said frustoconical section including said annular lip, and including a seal cap attached to the valve tube and retaining the base between the valve tube and the seal cap, said seal cap being spaced from at least a portion of the frustoconical section to allow fluid pressure loading of the annular lip against the riser.

13. A pop-up sprinkler comprising:

a housing;

a riser in the housing moveable between an extended position in which the riser extends from the housing and a retracted position in which the riser is retracted from the extended position;

a pressure regulator in said riser, said pressure regulator including a valve seat mounted within the riser and a valve tube moveable within the riser and cooperable with the valve seat to provide pressure regulation;

first and second axially spaced seals carried by said housing and cooperable with the riser, an aperture in the riser located so as to be between the first and second seals in said extended position whereby the first and second seals reduce the likelihood of clogging of the aperture and said second seal allows the passage of air whereby the aperture can serve as the vent for the pressure regulator; and said valve tube being coupled to the valve seat and forming a structure which can be installed as a unit in the riser.

14. A pop-up sprinkler as defined in claim 13 including a pressure activated seal between the valve seat and the valve tube.

15. A pop-up sprinkler as defined in claim 13 including a wiper seal mounted on the valve tube and having an annular lip engageable with the riser.

16. A pop-up sprinkler as defined in claim 15 including a pressure activated seal between the valve seat and the valve tube.

17. In a pop-up sprinkler which includes a housing, a riser in the housing movable between an extended position in which the riser extends from the housing and a retracted position in which the riser is retracted from the extended position, and a pressure regulator within the riser and wherein the pressure regulator includes a valve seat mounted within the riser and a valve tube having an upper end and wherein the valve tube is movable within the riser and cooperable with the valve seat to provide pressure regulation, the improvement comprising;

a wiper seal mounted on the valve tube and having an annular lip engageable with the riser above the upper end of the valve tube.

18. An improvement as defined in claim 17 including a seal cap for mounting the wiper seal on the valve tube.

19. An improvement as defined in claim 17 wherein the wiper seal includes an annular base and a peripheral section, said peripheral section including said annular lip, and including a seal cap attached to the valve tube and retaining the base between the seal tube and the seal cap, said seal cap being spaced from at least a portion of the frustoconical section to allow fluid pressure loading of the annular lip against the riser.

20. An improvement as defined in claim 21 wherein the seal cap and valve tube cooperate to support the peripheral section against rolling up during use.

21. An improvement as defined in claim 19 wherein the base can float between the seal cap and the valve tube.

22. In a pop-up sprinkler which includes a housing, a riser in the housing movable between an extended position in which the riser extends from the housing and a retracted position in which the riser is retracted from the extended position, and a pressure regulator within the riser and wherein the pressure regulator includes a valve seat mounted within the riser and a valve tube having upper and lower ends and wherein the valve tube is movable within the riser and cooperable with the valve seat to provide pressure regulation, the improvement comprising;

a wiper seal disposed between the riser and the valve tube.

23. An improvement as defined in claim 22 further comprising a pressure activated seal disposed between the valve tube and the riser.

24. A pop-up sprinkler as defined in claim 23 wherein the wiper seal is a first seal, the pressure actuated seal is a second seal;

the first and second seals are axially spaced, carried by said housing, and cooperable with the riser;

an aperture in the riser is located so as to be between the first and second seals in said extended position; whereby the first and second seals reduce the likelihood of clogging of the aperture and one of said first seal and second seal allows the passage of air whereby the aperture can serve as the vent for the pressure regulator.

25. An improvement as defined in claim 22 wherein the wiper seal is mounted on the valve tube and has an annular lip engageable with the riser above the upper end of the valve tube.

26. A method of making a pop-up sprinkler, comprising:

assembling a pressure regulator;

mounting the pressure regulator in a riser subsequent to said step of assembly;

assembling the riser into a housing so as to provide a pop-up sprinkler; and during the assembling step, capturing a spring between a shoulder in the valve tube and the spring support with the spring urging the valve tube and valve seat apart.

* * * * *